US007431523B2

(12) United States Patent
Hautvast et al.

(10) Patent No.: US 7,431,523 B2
(45) Date of Patent: Oct. 7, 2008

(54) PRINTER WITH WEDGE FOR CLOSING PAPER OUTLET SLOT

(75) Inventors: Heinz-Josef Hautvast, Brigachtal (DE); Thomas Riester, Villingen-Schwenningen (DE)

(73) Assignee: Siemens Aktiengesellschaft, Munich (DE)

( * ) Notice: Subject to any disclaimer, the term of this patent is extended or adjusted under 35 U.S.C. 154(b) by 573 days.

(21) Appl. No.: 11/086,456

(22) Filed: Mar. 23, 2005

(65) Prior Publication Data

US 2005/0196218 A1 Sep. 8, 2005

Related U.S. Application Data

(63) Continuation of application No. PCT/DE03/02751, filed on Aug. 18, 2003.

(30) Foreign Application Priority Data

Sep. 11, 2002 (DE) ..... 102 42 474
Feb. 11, 2003 (DE) ..... 103 05 634

(51) Int. Cl.
*B41J 29/12* (2006.01)
*B41J 29/00* (2006.01)

(52) U.S. Cl. ..... 400/693; 400/713

(58) Field of Classification Search ..... None
See application file for complete search history.

(56) References Cited

U.S. PATENT DOCUMENTS 3,122,228 A 2/1964 Dollenmayer et al.
4,533,966 A * 8/1985 Kume ..... 360/96.5
4,884,909 A 12/1989 Watanabe et al.
4,980,785 A * 12/1990 Talmadge ..... 360/97.02
5,300,763 A * 4/1994 Ito et al. ..... 235/475
5,626,252 A * 5/1997 Trotman ..... 220/789
5,710,688 A * 1/1998 Cihak et al. ..... 360/137
2001/0014245 A1 8/2001 Seres et al.
2006/0083564 A1 * 4/2006 Yazawa et al. ..... 399/363
2006/0288354 A1 * 12/2006 Ito ..... 720/601

FOREIGN PATENT DOCUMENTS

DE 1 268 157 5/1968

(Continued)

OTHER PUBLICATIONS

Abstract DE-PS 27 06 209; Aug. 17, 1978; Siemens AG, D-1000 Berlin and D-8000 München (Germany).

(Continued)

*Primary Examiner*—Daniel J Colilla
(74) *Attorney, Agent, or Firm*—Bell, Boyd & Lloyd LLP

(57) ABSTRACT

The invention relates to a printer having a paper transporting cylinder and a housing provided with a panel having a paper output slit. The printer also has a device for protecting against the penetration of dust and spray water. According to the invention, the device includes a wedge which, in a first position, closes the paper output slit when the printer is not in use, and, in a second position, opens the paper output slit when the printer is in use in such a way that paper can pass though the paper output slit. The invention also has a drive for displacing the closing wedge from the first position to the second position and back.

6 Claims, 2 Drawing Sheets

FOREIGN PATENT DOCUMENTS

| | | | | |
|---|---|---|---|---|
| DE | 27 06 209 | B2 | | 8/1978 |
| DE | 32 27 833 | C2 | | 1/1984 |
| EP | 1 148 013 | A2 | | 10/2001 |
| JP | 2002103766 | A | | 10/1990 |
| JP | 6255861 | A | | 9/1994 |
| JP | 09267535 | A | * | 10/1997 |
| JP | 2000301790 | A | * | 10/2000 |
| JP | 11174596 | A | | 4/2002 |
| JP | 2002240394 | A | * | 8/2002 |

OTHER PUBLICATIONS

Abstract DE PS 68 157; May 16, 1968; International Business Machines Corporation Armonk, US-New York (USA).

Derwent Abstract DE PS 32 27 833; Jan. 26, 1984 ; Nixdorf Computer AG, D-4790 Paderborn (Germany).

* cited by examiner

PRINTER WITH WEDGE FOR CLOSING PAPER OUTLET SLOT

CROSS REFERENCE TO RELATED APPLICATIONS

The present application is a continuation of international application PCT/DE2003/002751, filed on Aug. 18, 2003, which designated the United States and was pending at the time of designation; and further claims priority to German patent applications 10242474.8, filed Sep. 11, 2002, and 10305634.3, filed 11 Feb., 2003, all of which are herein incorporated by reference.

BACKGROUND OF THE INVENTION

The invention relates to a printer having a paper transporting roll and a housing having a front panel with a paper outlet slot. Printers of this type are used, for example, in motor vehicles in order to be able to output in paper form values stored in tachographs. Particularly in utility vehicles, because of the environmental conditions which occur therein, it is necessary to provide a device to protect against the penetration of dust and spray water. From the prior art, it is known to cover the printer completely or, when the printer is installed in a dashboard, to cover a corresponding front panel completely with a protective cap. In order to print out values, this cap either has to be removed by hand or moved away by a complicated mechanism.

SUMMARY OF THE INVENTION

It is an object of the invention to specify a device which is constructed simply, with which the penetration of dust and spray water can be prevented and which requires no additional activities on the part of the user of the printer. This object is achieved in that the device has a wedge which, in a first position, closes the paper outlet slot when the printer is not being used and, in a second position, when the printer is being used, opens the paper outlet slot in such a way that paper can pass through the paper outlet slot, and in that there is a drive for moving the closure wedge from the first into the second position and back.

It is an advantage in this case that, when it is in the second position, the closure wedge is simultaneously present to guide the paper, since the paper is not folded by the wedge shape. Furthermore, the wedge can form a tear-off edge for the paper.

The fact that the wedge tapers in the direction of the inner side of the printer housing means that a particularly flat front panel surface can be implemented in the first position and, at the same time, in the second position the tear-off edge for the paper can be located on the outside, since, in such a configuration, the wedge has to be moved outward from the first to the second position.

The fact that the wedge has an extension which extends into the housing means that the wedge can be moved simply from inside the housing.

The fact that the extension is connected to the paper transporting roll via a clutch means that no separate drive motor is required for the movement of the wedge.

A frictional clutch can be used particularly simply.

It is also possible to provide a toothed mechanism, such as a rack on the extension and a gear on the paper transporting roll, with an additional clutch, in order to be able to switch off the drive when the second position is reached.

The construction of the device is particularly simple if the wedge can be pivoted about an axis of rotation during the movement between the two positions. It is also possible to move the wedge between the two positions by means of a carriage.

BRIEF DESCRIPTION OF THE SEVERAL VIEWS OF THE DRAWINGS

The invention will be explained in more detail below by using the figures for a particularly preferred exemplary embodiment, in which.

DETAILED DESCRIPTION OF THE INVENTION

Figure 1:
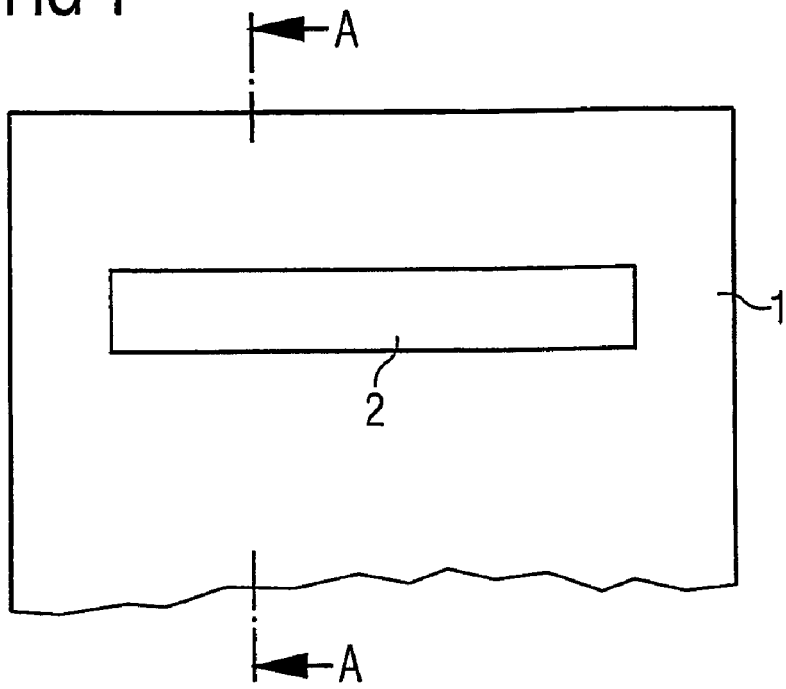
FIG. 1 shows the view of a front panel having a closure wedge.

In FIG. 1 it is possible to see a front panel 1 and a closure wedge 2, which closes a paper outlet slot that is not visible in FIG. 1.

Figure 2:
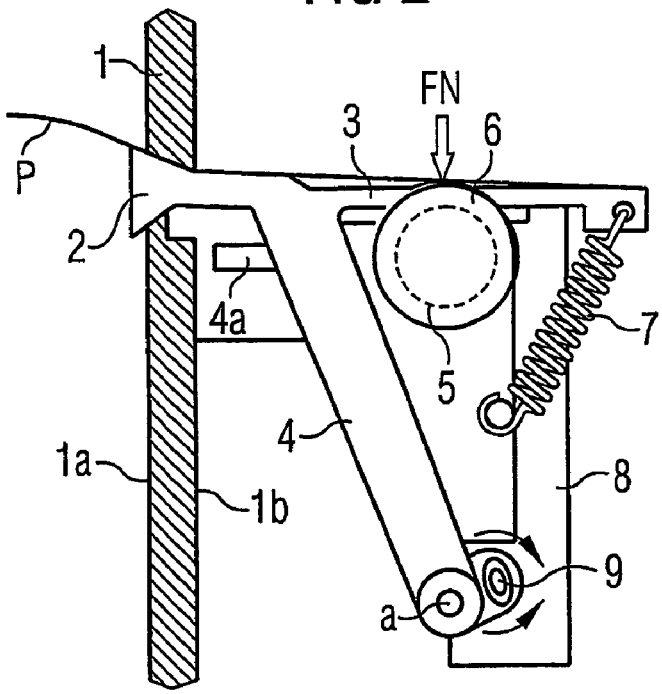
FIG. 2 shows the section A-A through FIG. 1 with the closure wedge in a first position.

FIG. 2 shows the closure wedge 3 in the front panel 1 in a first, closed position. The front panel 1 has an outer housing side 1*a* and an inner housing side 1*b*. The closure wedge 2 tapers in the direction of the inner housing side 1*b* and continues in an extension 3 and a lever 4 having a stop 4*a*. Furthermore, FIG. 2 shows a drive roll 5, a paper transporting roll 6, a spring element 7, paper P and a printer module 8 having a paper roll 9. An axis of rotation a of the lever 4 and therefore also of the closure wedge 2 is located below the drive roll 5. The spring element 6 presses the extension 3 onto the drive roll 5. The paper P is clamped in between the closure wedge 2 and the front panel 1. In this way, the paper outlet slot is sealed off against dust and spray water.

Figure 3:
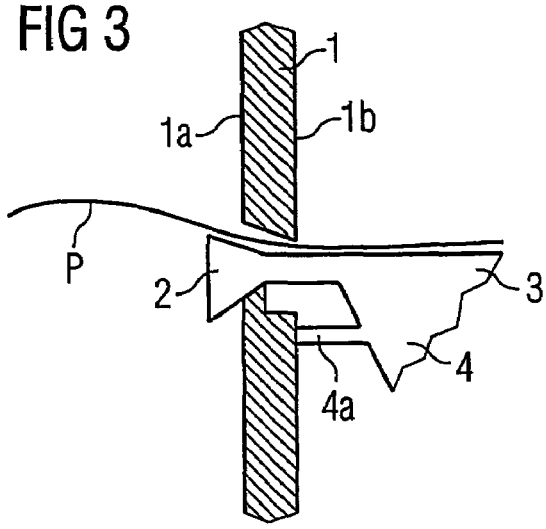
FIG. 3 shows a part of the section from FIG. 2 with the closure wedge in a second position.

In FIG. 3, the closure wedge 2 is in its second position, so that the paper outlet slot is partly opened and the paper P can pass unimpeded through the paper outlet slot.

Figure 4:
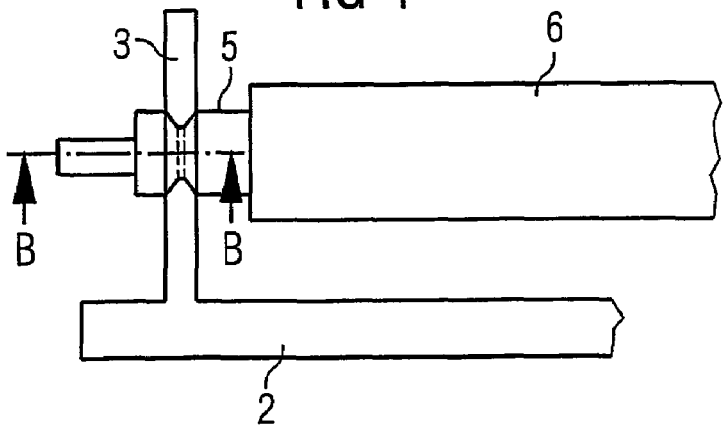
FIG. 4 shows the bottom view of the closure wedge from FIG. 2 with a paper transporting roll.
Figure 5:
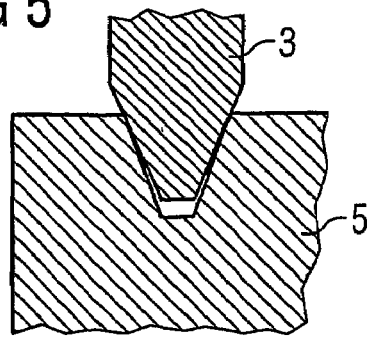
FIG. 5 shows a part of the section B-B from FIG. 4.

In FIG. 4 it can be seen that the paper transporting roll 6 and the drive roll 5 are connected coaxially to each other and the interaction between the extension 7 and the drive roll 5 is configured as a friction clutch. For this purpose, the extension 3 has a wedge-shaped configuration in its lower region, which engages in a wedge-shaped groove in the drive shaft 5 (see FIG. 5).

The spring element 5 presses the extension 3 onto the drive roll 5. When the paper is advanced, the paper P is moved by the rotational movement of the paper transporting roll 6. Furthermore, the drive roll 5 moves the closure wedge 2 via the extension 3 and in this way opens the paper outlet slot. The required frictional force between the extension 3 and the drive roll 5 can be chosen appropriately via the roll profile and the pulling force of the spring element 6.

The connection between the extension 3 and the drive shaft 5 serves at the same time as a slipping clutch when the second position, illustrated in FIG. 2, is reached and the stop 4*a* is resting on the inner side 1*b* of the front panel 1.

The paper outlet slot is closed by the rotational movement of the paper transporting roll 6 and therefore of the drive roll 5 being reversed and being driven until the closure wedge is 2 is resting on the front panel 1 and closes the paper outlet slot completely, and the paper outlet slot is thus protected against dust and spray water.

The invention claimed is:

1. A printer comprising:

a paper transporting roll;

a housing having a front panel with a paper outlet slot, the housing further comprising an outer side and an inner side;

a device arranged to protect against penetration of dust and spray water into the front panel, the device comprising a wedge wherein the wedge is configured to close, in a first position, the paper outlet slot when the printer is not being used and to open, in a second position, when the printer is being used, the paper outlet slot such that paper can pass through the paper outlet slot, wherein the wedge tapers from an outer wedge portion towards an inner wedge portion in direction of the inner side of the housing; and a drive coupled to the inner wedge portion of the wedge, and configured to move the wedge from the first into the second position and back again.

2. The printer according to claim 1, wherein the wedge further comprises an extension which extends into the housing.

3. The printer according to claim 2, wherein the extension is arranged to be connected to the paper transporting roll via a clutch.

4. The printer according to claim 3, wherein the clutch has a clutching function provided by friction.

5. The printer according to claim 2, wherein the wedge is configured to rotate about an axis of rotation in order to change its position from the first position to the second position.

6. The printer according to claim 1, wherein the drive is provided via a toothed mechanism which, when the second position is reached, is disengaged by means of a clutch.

* * * * *